US005569044A

United States Patent [19]

Huang

[11] Patent Number: 5,569,044

[45] Date of Patent: Oct. 29, 1996

[54] CHRISTMAS LAMP SOCKET

[76] Inventor: Shun-Feng Huang, No. 13, Lane 84, Nei Hu Road, Hsin-Chu City, Taiwan

[21] Appl. No.: 389,647

[22] Filed: Feb. 16, 1995

[51] Int. Cl.[6] ..... H01R 4/50

[52] U.S. Cl. ..... 439/340; 439/419

[58] Field of Search ..... 439/417, 418, 439/419, 340, 611–619, 661–667, 865, 86

[56] References Cited

U.S. PATENT DOCUMENTS

| | | | |
|---|---|---|---|
| 3,609,643 | 9/1971 | Connan | 439/419 |
| 4,184,734 | 1/1980 | Toorell | 439/340 |
| 5,385,485 | 1/1995 | Fu | 439/419 |
| 5,439,389 | 8/1995 | Cheng et al. | 439/419 |

*Primary Examiner*—Hien D. Vu

*Attorney, Agent, or Firm*—Morton J. Rosenberg; David I. Klein

[57] ABSTRACT

A Christmas lamp socket is provided that includes a socket body and an inner cylindrical wall inserted into the socket body. The socket body has two opposing elongate vertically directed plates inside, an annular groove formed in an inner surface at an upper end thereof. The inner cylindrical wall is formed by two semi-cylindrical walls combined together, each wall having a vertical slot formed in an outer surface for receiving a respective one of the two vertical plates of the socket body therein. Each wall also has an annular ridge formed on an outer surface at the upper end thereof for engagement with the annular groove of the socket body to stably couple the cylindrical inner wall to the socket body. A threaded portion is formed on each inner wall to mate with a threaded metal portion of a lamp. A slot is formed between abutting vertical ends of the two semi-cylindrical inner walls for an elongate conductor to extend therein and protrude out of the slot to contact the metal screw base of a lamp.

1 Claim, 2 Drawing Sheets

CHRISTMAS LAMP SOCKET

BACKGROUND OF THE INVENTION

This invention concerns a Christmas lamp socket. In particular, the present invention is a lamp socket having a little elasticity to allow for expansion and contraction to keep a Christmas lamp stably therein, as even the lamp itself expands or shrinks as a result of the heat it produces.

A known conventional Christmas lamp socket shown in FIG. 3 generally has a hollow socket body 10 made of plastic. The socket body 10 has a threaded portion 20 for threaded engagement with a Christmas lamp 70. Conductors 30 are respectively provided on a vertical inner surface and one the bottom, and are respectively connected to wires 40 at an outer end thereof. Two air holes 50, 50 are formed through opposing sides of the bottom of the socket body 10. A clamping arm 60 is provided on an outer surface of the socket body 10. After a Christmas lamp 70 is screwed in the socket body 10, respective portions of the metal portion 701 make contact with the two conductors 30, 30 to be energized when powered. The threaded portion 20 of the socket body 10 is formed by injection molding process, and is unable to have a very deep depth, being restricted by retreating movement of a mold. The Christmas lamp 70 may loosen in the socket body 10, owing to expansion and contraction caused by the heat produced by the lamp after a long period of use. Therefore, this type of conventional socket may not be able to meet the standards established by Underwriters Laboratories (U. L.). Even if U. L. standards can be met, a Christmas lamp loses its tightness in such a conventional socket body after being used for a period of time.

SUMMARY OF THE INVENTION

This invention has been devised to offer a Christmas lamp socket having sufficient elasticity to allow for expansion and contraction to correspond to expansion and contraction of a Christmas lamp.

A Christmas lamp socket in the present invention includes an inner cylindrical wall deposited in a hollow socket body. The inner wall consists of two semi-cylindrical walls combined together so as to have a proper elasticity for the socket body to absorb expansion or contraction of a Christmas lamp. Then, when a Christmas lamp placed in this socket expands or contracts as a result of the heat it produces when lit, it can be kept stable within the inner wall.

BRIEF DESCRIPTION OF THE DRAWINGS

The invention will be better understood by reference to the accompanying drawings, wherein.

DESCRIPTION OF THE PREFERRED EMBODIMENTS

Figure 3:
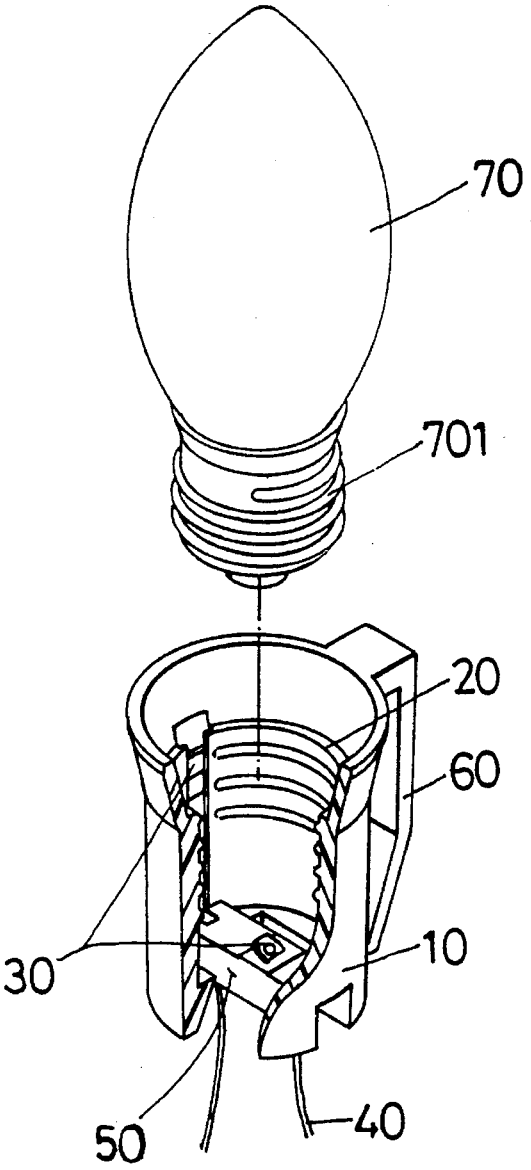
FIG. 3 (PRIOR ART)
Figure 1:
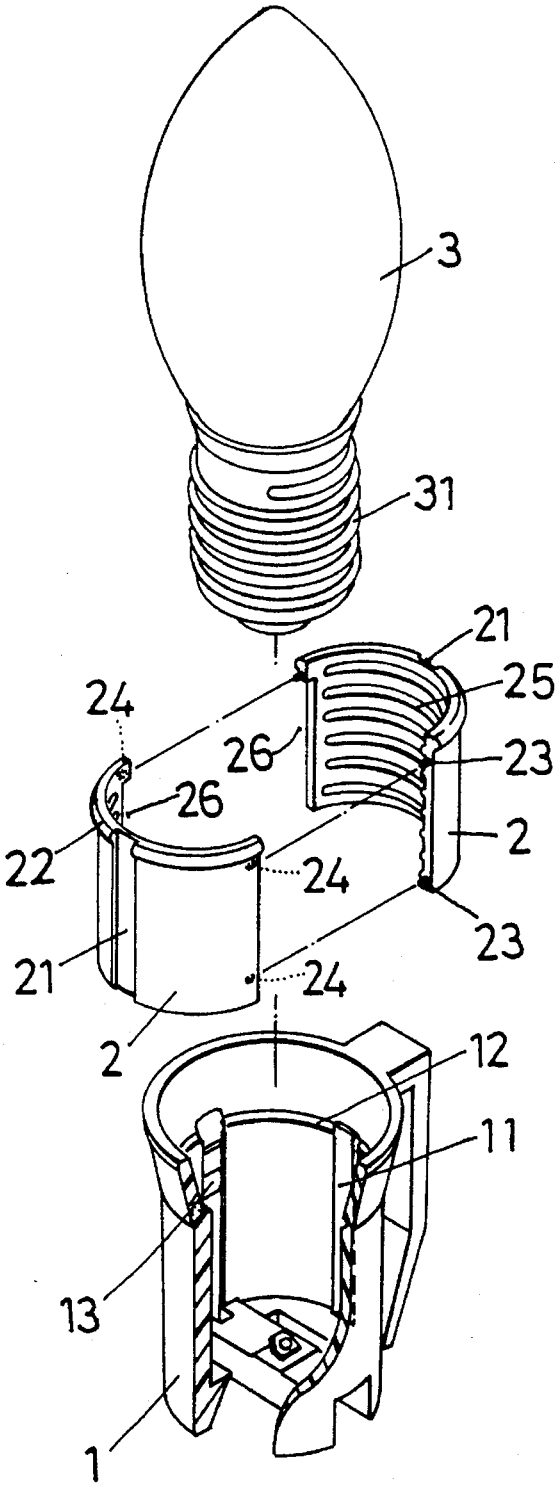
FIG. 1 is an exploded perspective view of a Christmas lamp socket of the present invention.
Figure 2:
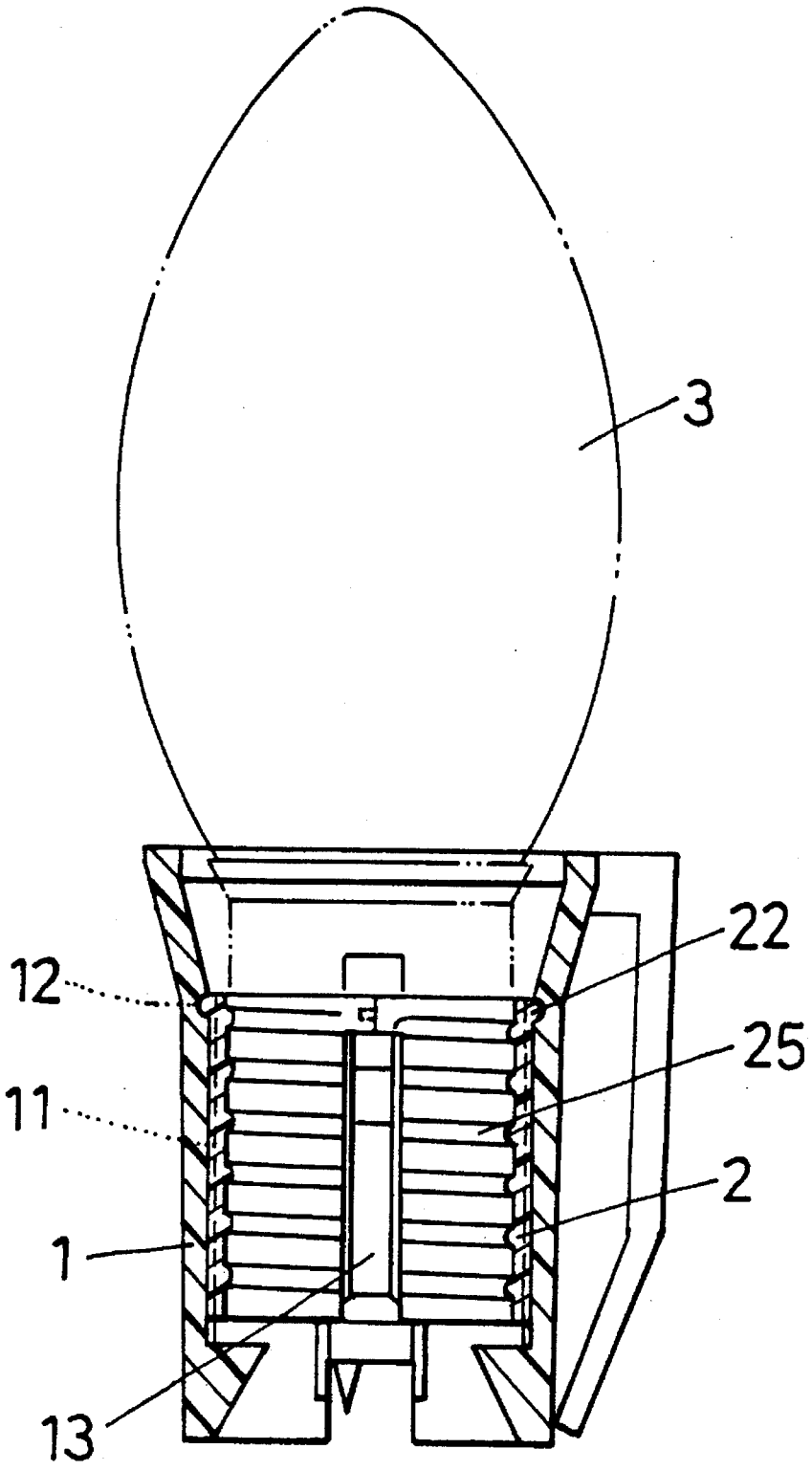
FIG. 2 is a cross-sectional elevation view of the Christmas lamp socket of the present invention; and, FIG. 3 is an exploded perspective view of a known conventional Christmas lamp socket.

A Christmas lamp socket in the present invention, as shown in FIGS. 1 and 2, includes a hollow socket body I having two opposing inwardly projecting vertically directed elongate plates 11, 11 and an annular groove 12 formed in an inner surface at the upper end thereof. A cylindrical inner wall is formed by two semi-cylindrical walls 2, 2 fit together and disposed within the hollow socket body 1. Each semi-cylindrical wall 2 has a vertically directed slot 21 formed in an intermediate portion of an outer surface thereof to receive the vertically directed elongate plate 11 of the socket body 1 therein. An upper annular ridge 22 is formed on the outer surface of each semi-cylindrical wall 2, to engage with the annular groove 12 of the socket body 1 with a little tightness, and a threaded portion 25.

A first of the pair of inner walls 2 has a plurality of projections 23 extending respectively from the two vertical end surfaces of the inner wall. A second of the pair of inner walls 2 has a plurality of holes 24 respectively formed in the two vertical end surfaces of the wall in aligned relation to the plurality of projections 23 so that the two semi-cylindrical inner walls 2, 2 may be stably combined together before insertion into the opening of the hollow socket body 1. A vertically directed recess 26 is formed in one abutting vertical end of each of the two semicylindrical inner walls 2, 2 to form a slotted through opening after they are combined together. An elongate conductor 13 is positioned within the slotted through opening, with an upper portion of the conductor 13 projecting out from the slotted opening.

When a Christmas lamp 3 is to be screwed into the socket body 1, referring to FIG. 2, the lamp 3 is placed in the opening defined by the two semi-cylindrical inner walls 2, 2, with the threaded metal portion 31 of the lamp 3 being threadedly engaged with the threaded portion 25 of the inner walls 2, 2. The lamp 3 is then stably coupled to the socket body 1, and ready to be lit. Even if the lamp 3 should be kept lit for a long period of time and produces sufficient heat to cause it to expand, it will be kept stably in the socket body 1, with the inner walls 2, 2 expanding at the same time. When the lamp is turned off, becomes cool and contracts, it will also be kept stably therein, with the inner walls 2, 2 also contracting, preventing the lamp 3 form moving to and fro or otherwise loosening.

While the invention has been described with respect to a preferred embodiment, it is obvious that various modifications can be made thereto without departing from the spirit of present invention which should be limited only by the scope of the appended claims.

What is claimed is:

1. A Christmas lamp socket comprising:

a socket body open on one end and having a cylindrical wall extending from a bottom wall to define a cavity therein, said cylindrical wall having an annular groove formed in an inner surface thereof adjacent said open end, said socket body having a pair of inwardly projecting vertically directed elongated plate members disposed on opposing sides of said cavity;

a pair of semi-cylindrical inner wall members being coupled together to form a cylindrical tube inserted into said cavity, each of said pair of inner wall members having opposing interior and exterior wall surfaces and a pair of opposing ends, one of said pair of inner wall members having a plurality of projections extending from said opposing ends thereof and the other of said pair of inner wall members having a plurality of apertures formed in said opposing ends thereof for receiving said plurality of projections respectively therein to couple one inner wall member to the other, a corresponding one of said pair of opposing ends of each of said pair of inner wall members having a recess formed therein for forming a slotted through opening in said cylindrical tube, each of said pair of inner wall members having an elongated vertically directed slot formed in said exterior wall surface intermediate said pair of opposing ends thereof for receiving a respective one of said pair of inwardly projecting vertically directed elongated plate members therein, each of said pair of inner wall members having an semi-annular ridge formed on an upper edge thereof for insertion into a respective portion of said annular groove, each of said pair of inner wall members having a threaded portion formed in said interior surface thereof for forming a lamp receiving thread on an interior of said cylindrical tube; and, a pair of electrical contacts, a first of said pair of electrical contacts extending through an opening formed in said bottom wall of said socket body and a second of said pair of electrical contacts extending through said slotted through opening in said cylindrical tube for contacting corresponding portions of a lamp threadedly engaged with said lamp receiving thread.

* * * * *